US006427406B1

(12) United States Patent
Weaver et al.

(10) Patent No.: US 6,427,406 B1
(45) **Date of Patent: *Aug. 6, 2002**

(54) MONOLITHIC STUD FORM FOR CONCRETE WALL PRODUCTION

(75) Inventors: Gary L. Weaver, Ephrata; Robert G. Martin, Narvon, both of PA (US)

(73) Assignee: SWA Holding Company, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/381,418

(22) PCT Filed: Dec. 11, 1998

(86) PCT No.: PCT/US98/26349

§ 371 (c)(1),
(2), (4) Date: Sep. 20, 1999

(87) PCT Pub. No.: WO99/29982

PCT Pub. Date: Jun. 17, 1999

(51) Int. Cl.[7] ..... E04B 1/18

(52) U.S. Cl. ..... 52/414; 52/481.1; 52/251; 52/733.3; 52/376

(58) Field of Search ..... 52/414, 630, 602, 52/320, 319, 324, 731.5, 731.7, 731.8, 731.9, 737.6, 81.3, 81.1, 633, 655.1

(56) References Cited

U.S. PATENT DOCUMENTS

| | | | | | |
|---|---|---|---|---|---|
| 496,463 | A | * | 5/1893 | White | |
| 5,111,628 | A | | 5/1992 | Desjoyaux et al. | 249/35 X |
| 5,313,753 | A | * | 5/1994 | Sanger | 52/251 |
| 5,440,848 | A | * | 8/1995 | Deffet | 52/376 |
| 5,596,859 | A | * | 1/1997 | Horton et al. | 52/733.3 |
| 5,797,233 | A | * | 8/1998 | Hascall | 52/481.1 |
| 6,003,278 | A | * | 12/1999 | Weaver et al. | 52/414 |

* cited by examiner

*Primary Examiner*—Carl D. Friedman
*Assistant Examiner*—Steve Varner
(74) *Attorney, Agent, or Firm*—Buchanan Ingersoll, P.C.

(57) ABSTRACT

A stud form and system for forming a preformed concrete wall panel having a solid portion and a plurality of vertical concrete studs joined to the solid portion. The stud form includes a substantially U-shaped channel having a face portion that defines an elongated plane and leg portions extending along side of and away from the elongated plane to define a predetermined channel depth. The stud form further includes means for integrally connecting the stud form to the solid portion of the wall panel with the channel opened toward the solid portion.

30 Claims, 13 Drawing Sheets

MONOLITHIC STUD FORM FOR CONCRETE WALL PRODUCTION

This application claims priority from U.S. patent application Ser. No. 08/989,333, filed Dec. 11, 1997, now U.S. Pat. No. 6,003,278.

BACKGROUND OF THE INVENTION

1. Field of the Invention

The present invention relates generally to the field of prefabricated concrete wall construction, and more specifically, to a prefabricated concrete stud wall panel and method of forming the same.

2. Description of the Prior Art

In response to problems with traditional block construction methods, prefabricated wall panels were developed for rapid construction of buildings. Prefabricated wall panels are shown in U.S. Pat. Nos. 4,751,803, 4,934,121, 5,055,252 and 5,313,753. Two types of prefabricated concrete walls which are commonly used are cavity walls having open pockets between spaced vertical studs and planar walls having insulation panels between the vertical studs to form a substantially planar surface. While both of these types of prefabricated wall panels are generally superior to traditional block construction in terms of costs, performance and reliability, there are still problems associated with both.

Many cavity walls use preformed concrete studs from a prior pour where they are formed separately from the top and base beams. A subsequent pour is then necessary to integrate the vertical studs with the top and base beams. As a result, walls formed in this manner require additional pouring and curing time and are often weaker than walls formed from a monolithic pour. Monolithic concrete cavity walls are typically formed by pouring concrete into frames which have forming channels for the vertical studs and the top and base beams. However, it is often difficult to remove the finished wall panel from the forming channels without damaging the concrete studs or beams.

In addition to the above, it is often necessary to provide a wood stud at the face of the concrete studs. This is often accomplished by laying wood strips in the forming channels prior to pouring. Typically, the wood strips have a series of nails projecting therefrom and the concrete cures around the nails to secure the wood studs. The process of providing nails in each of the wood strips is time consuming and adds to the manufacturing costs. Additionally, the wood strips are susceptible to cracking and warping, particularly when they are exposed to the wet concrete.

The planar walls are typically formed by placing wall studs, insulation, and reinforcing means in a forming assembly and filling the assembly with concrete. The studs and insulation are generally provided with projections which are surrounded by the concrete to integrate the studs and insulation into the wall. Planar walls which utilize wood studs often experience the same problems as the cavity walls do. U.S. Pat. Nos. 5,313,753 and 5,381,635 suggest mounting other common studs, metal or plastic studs, to the front faces of the concrete studs. However, these studs are merely secured to the front of the concrete studs by narrow flanges which may pull from the concrete. As the size of the flanges is increased, the chance that the concrete will fail to flow between and around the flanges also increases. Another problem associated with these metal and plastic studs on the vertical concrete face is that there is no way of passing service lines, such as, plumbing and electrical wiring, through the vertical studs.

Accordingly, there exists a need for a monolithic concrete wall which is easy to form, includes integral attachment stud surfaces and overcomes the disadvantages of the prior art.

SUMMARY OF THE INVENTION

The present invention generally relates to a stud form of a type used in forming a preformed concrete wall panel having a solid portion and a plurality of vertical concrete studs joined to the solid portion. The stud form includes a substantially U-shaped channel having a face portion that defines an elongated plane and leg portions extending along side of and away from the elongated plane to define a predetermined channel depth. The stud form further includes means for integrally connecting the stud form to the solid portion of the wall panel with the channel opened toward the solid portion.

The present invention also includes preformed concrete walls which incorporate the stud form and a system for forming such.

DETAILED DESCRIPTION OF THE PREFERRED EMBODIMENTS

Figure 1:
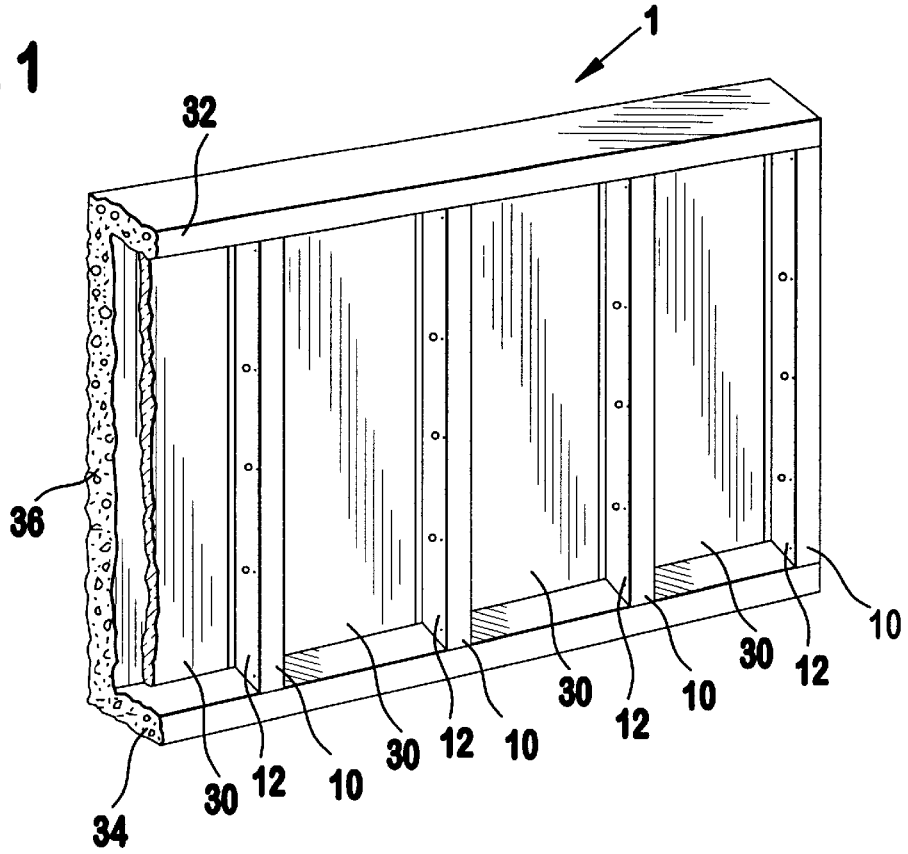
FIG. 1 an isometric view of a cavity wall panel made in accordance with the present invention.

The preferred embodiments will be described with reference to the drawing figures wherein like numerals represent like elements throughout. References to orientation refer to the orientation of an installed wall panel and are for clarity only.

FIG. 1 shows a cavity wall panel 1 made in accordance with the present invention. The cavity wall panel 1 preferably comprises spaced vertical studs 10 extending between top beam 32 and base beam 34. The vertical studs 10 include a filled stud channel 12 formed integral with the wall panel 1. Insulation panels 30 are recessed from the inside face of the wall 1 and extend between the vertical studs 10 and top and base beams 32 and 34. A concrete surface 36 extends along the back of the wall panel 1.

Figure 1A:
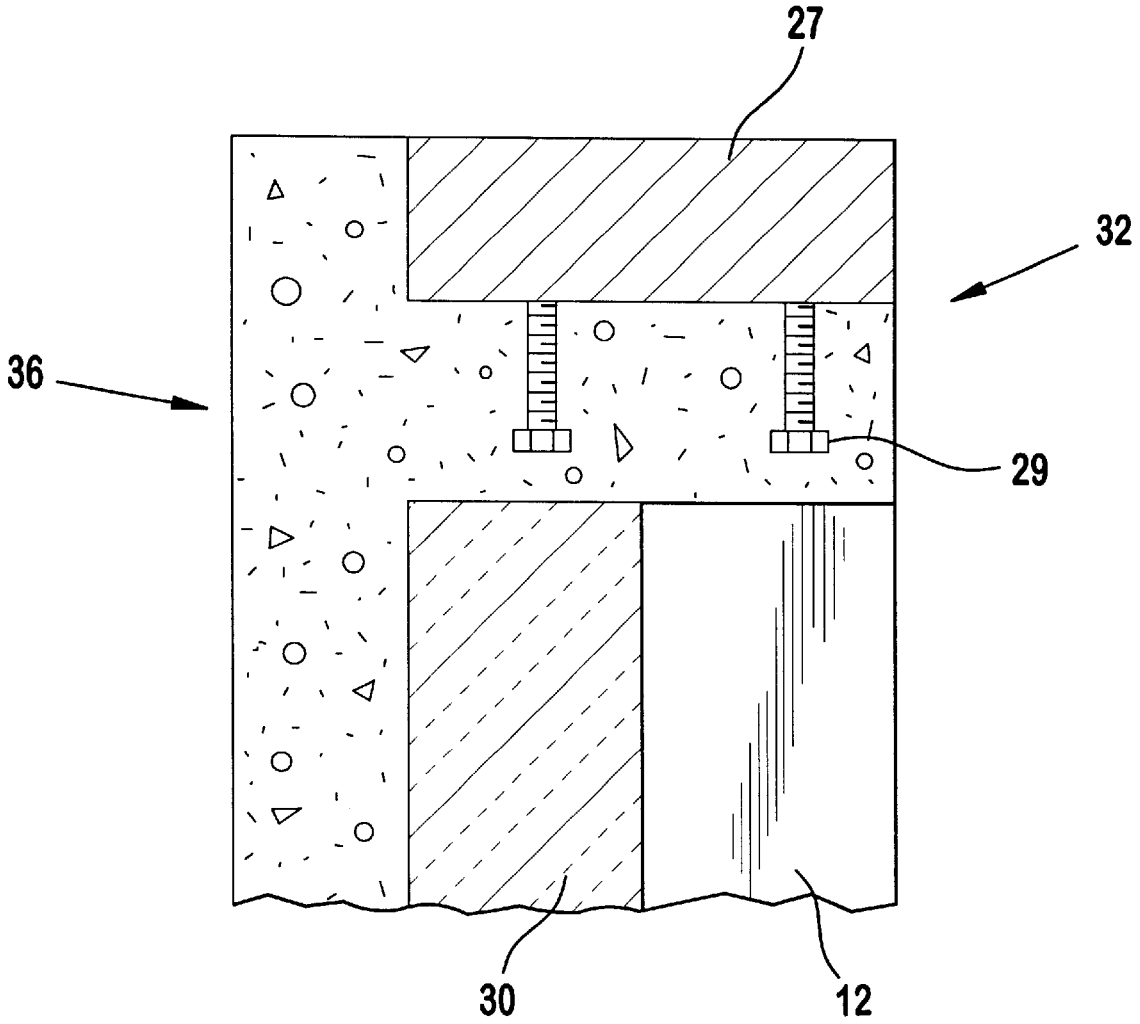
FIG. 1A is a partial sectional view of an alternate cavity wall panel.

As shown in FIG. 1A, the wall panel 1 may also include a connection plate 27 extending along the top beam 32. The connection plate 27 is preferably a wood stud with a plurality of lag bolts 29 extending therefrom. The connection plate 27 is positioned in the frame prior to pouring and then the poured concrete cures around the lag bolts 29 to secure the connection plate 27. The connection plate 27 permits additional framing members to be nailed directly to the wall panel 1.

Figure 2:
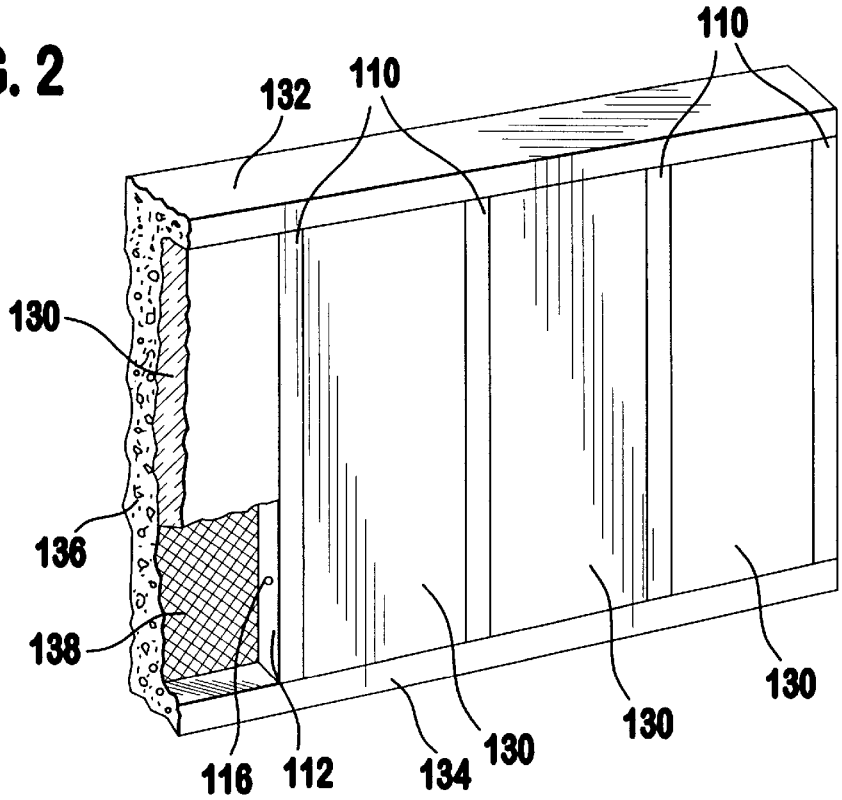
FIG. 2 is an isometric view of a planar wall panel made in accordance with the present invention.

FIG. 2 shows a preferred planar wall panel 101 made in accordance with the present invention. The planar wall panel 101 generally comprises spaced vertical studs 110 extending between top beam 132 and base beam 134. The vertical studs include a filled stud channel 112 which is integral with the wall panel 101. Insulation panels 130 extend between the vertical studs 110 and with studs 110 form a planar inside face on the wall 101. The outside face of the wall has a planer concrete surface 136. A wire lath 138 may also be included behind the insulation panels across the entire area of the wall panel 101. A connection plate 27 may also be provided in the planar wall panel 101.

Figure 3:
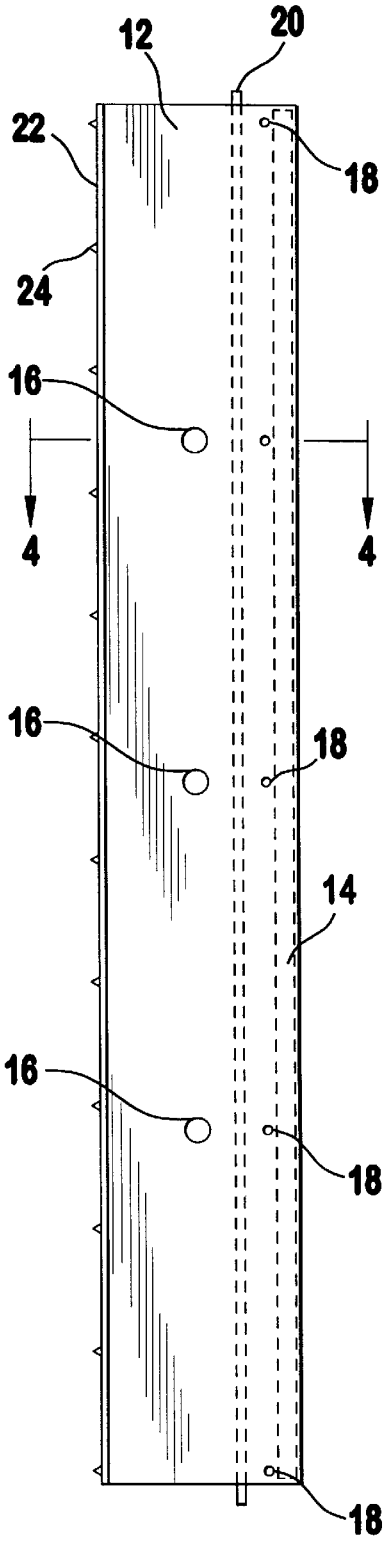
FIG. 3 is an elevation view of a vertical stud form used in the wall panel shown in FIG. 1.
Figure 4:
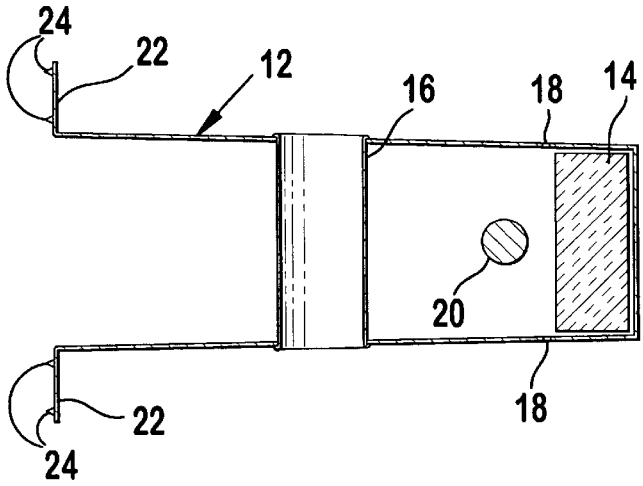
FIG. 4 is a section view taken along the line 4—4 in FIG. 3.

A first embodiment of a stud form 12 used in the cavity wall panel 1 is shown in FIGS. 3 and 4. It is preferably made from metal or plastic and forms an integral part of the vertical studs 10. The stud form 12 is generally a U-shaped channel. It is preferably slightly longer than the length of a vertical stud 10 so that it extends into the top and base beams 32 and 34 of the finished wall. Rebar 20 is positioned in each of the stud forms 12 to tie the vertical studs with the top and base beams 32 and 34. Flanges 22 extend outward from each open end of the channel and are substantially parallel to the face of the form 12. Each of the flanges 22 has a plurality of projections 24 extending therefrom for maintaining the insulation panels 30 in position during forming of the cavity wall panel 1, as will be described in more detail hereinafter. Insulation 14 is placed in the stud form 12 U-channel and extends the length thereof. The insulation 14 provides an area in each vertical stud 10 which is substantially concrete free and allows screws or other fasteners to be set directly into the stud forms 12 in the finished wall. Since finishing materials, such as sheet rock, can be fastened directly to the integral stud forms 12, separate nailing strips are not required.

As shown in FIGS. 3 and 4, sleeves 16 extend between the sides of the stud form 12 at various positions along its length. Each end of each sleeve 16 is preferably flattened over to hold the side walls of the stud form 12 between the ends of the sleeve 16. In the finished wall panel 1, the sleeves 16 are enclosed in the cured concrete and thereby integrate the forms 12 with the finished wall. The sleeves 16 also provide a conduit for electrical wires, plumbing and the like.

A plurality of weep holes 18 are provided through each side of the stud form 12 near the front thereof. The weep holes 18 are checked during pouring of the cavity wall panel 1 to ensure that concrete is properly flowing to the front of the stud form 12.

Alternate embodiments of the cavity wall stud form 212 are shown in FIGS. 5–9. Each of these alternate cavity wall stud forms 212 has a structure similar to that of stud form 12 of FIGS. 3 and 4, however, the support flange 222 extends inward and has a interconnection flange 230 extending therefrom. The support flanges 222 may be provided with projections for maintaining the insulation panels 30 in position, but are generally not required.

Figure 5:
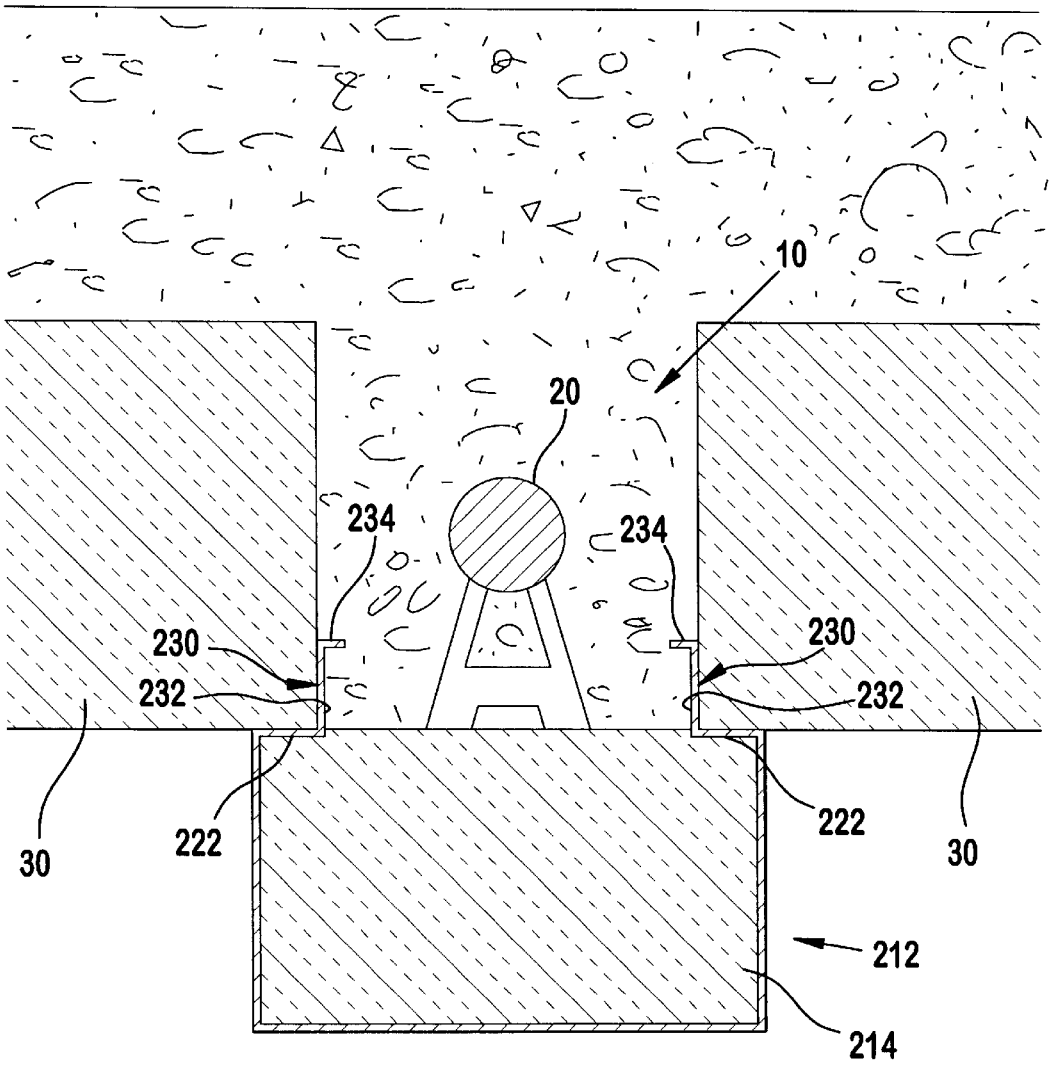
FIG. 5 is a section of a cavity wall showing an alternate vertical stud form.
Figure 6:
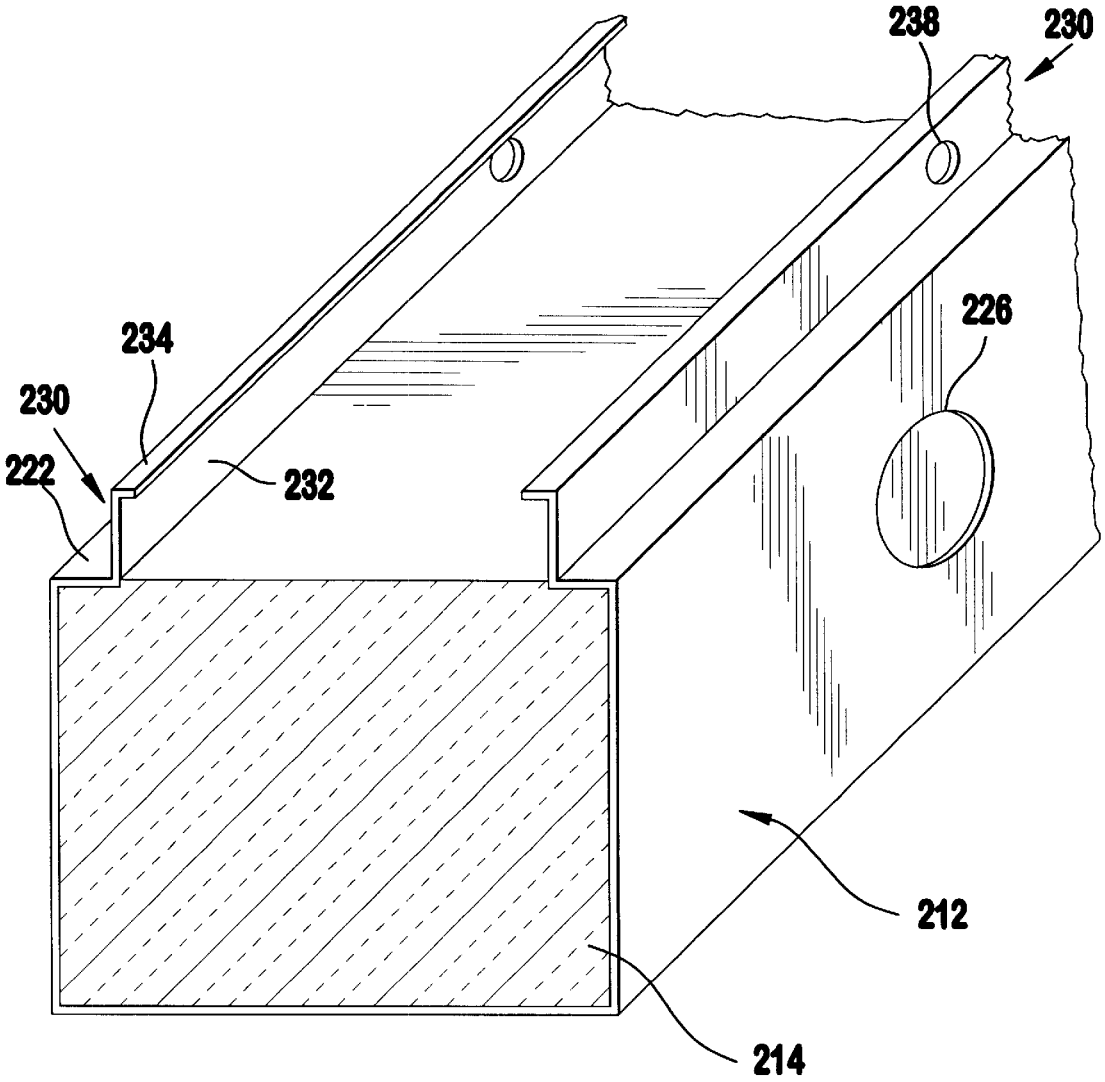
FIG. 6 is a partial isometric view of the vertical stud form of FIG. 5.
Figure 7:
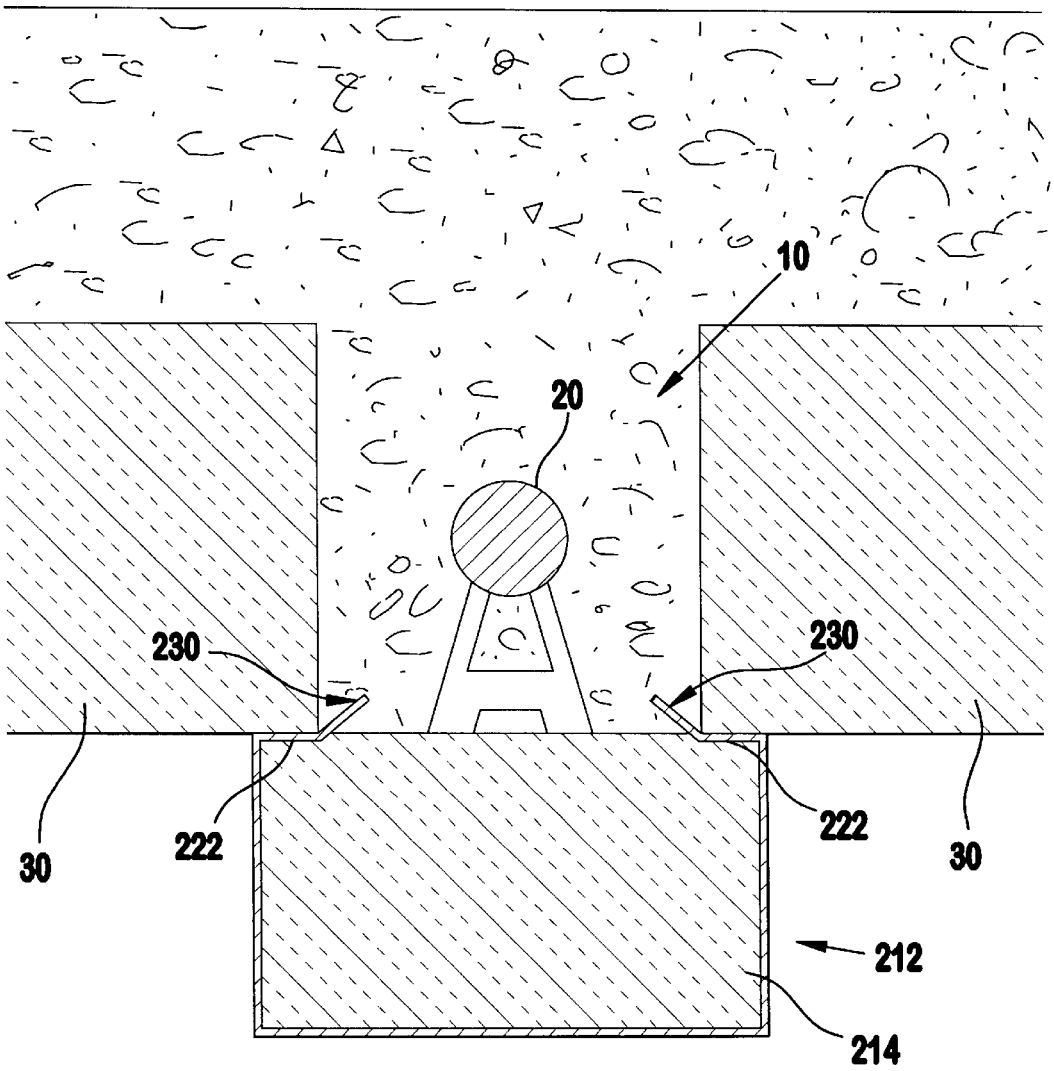
FIG. 7 is a section of a cavity wall showing an alternate vertical stud form.
Figure 8:
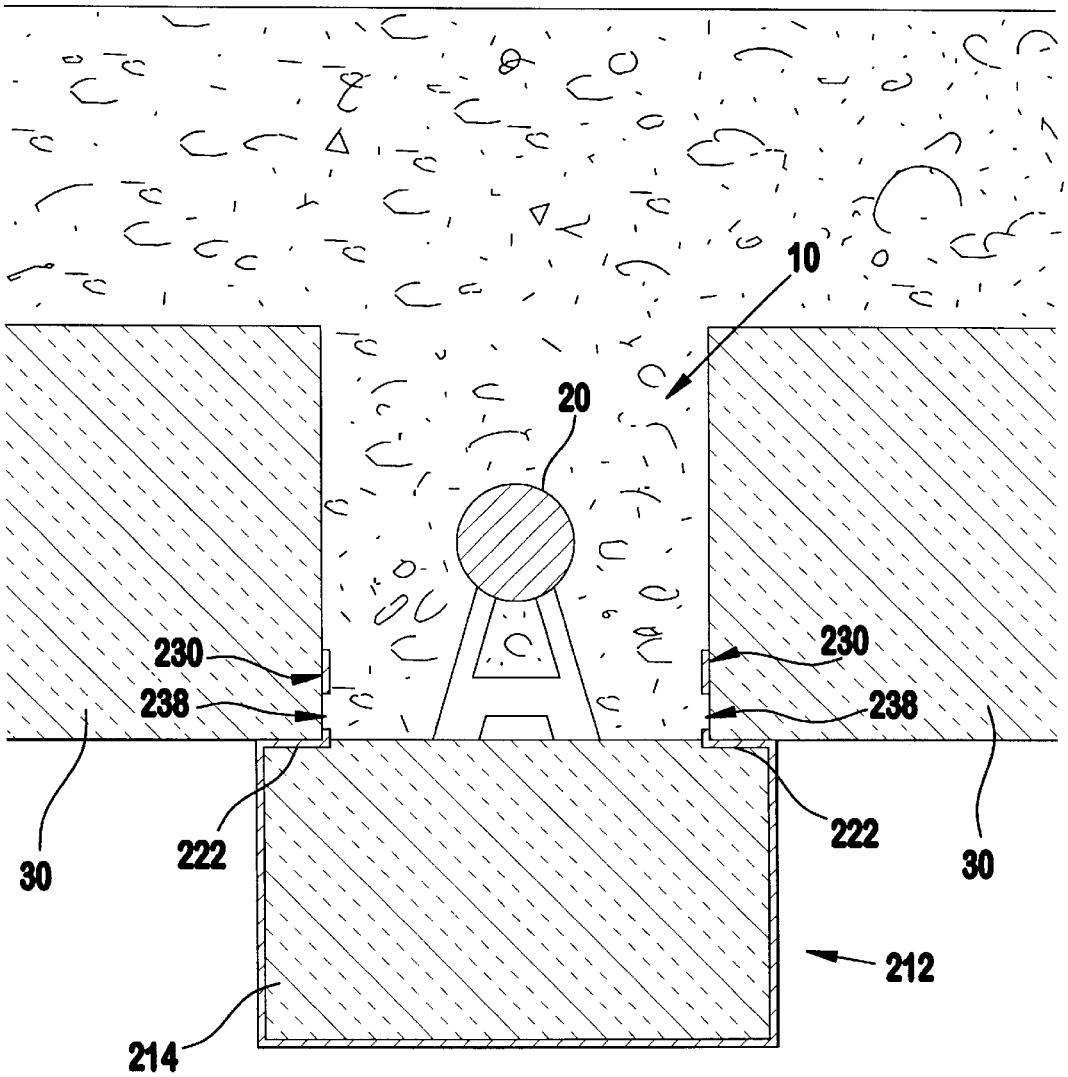
FIG. 8 is a section of a cavity wall showing an alternate vertical stud form.
Figure 9:
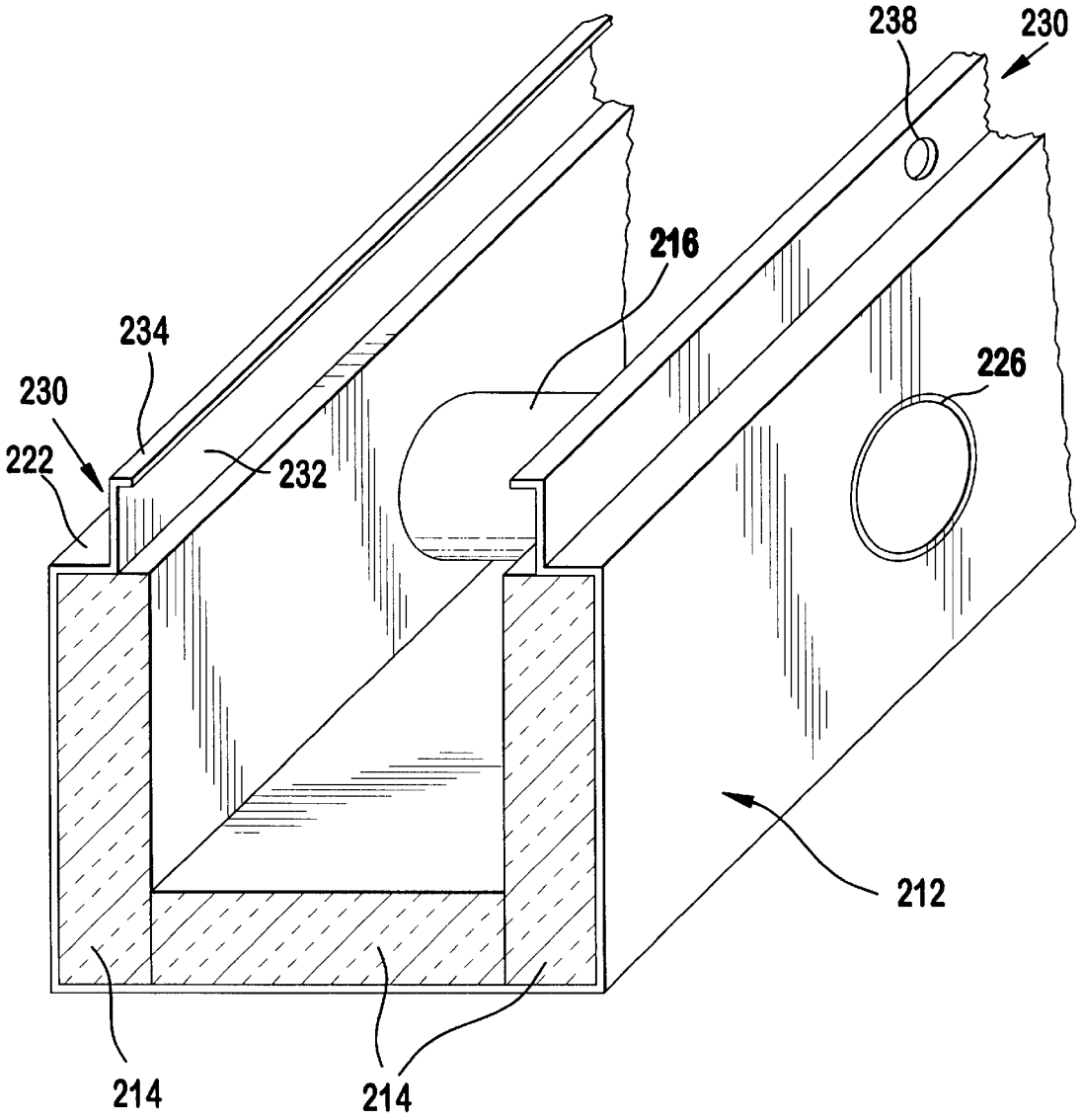
FIG. 9 is a partial isometric view of an alternate vertical stud form.

In the embodiments of FIGS. 5, 6 and 9, each interconnection flange 230 is a generally L-shaped member with a first portion 232 extending generally parallel to the legs of the U-shaped channel and a second portion 234 extending generally perpendicular thereto. The second portion 234 extends into and embeds in the concrete vertical stud 10 to maintain the stud form 212 in position. In the embodiment shown in FIG. 7, the interconnection member 230 extends from the support flange 222 at a substantially 45° angle and embeds into the concrete stud 10 to maintain the stud form 212 in position. In the embodiment shown in FIG. 8, the interconnection member 230 extends generally perpendicular to the support flange 222. A plurality of holes 238 are provided in the interconnection flange 230 along its length. The poured concrete flows through the holes 238 and thereby interconnects the stud form 212 with the concrete stud 10. As shown in FIG. 6, the interconnection flanges 230 of each of these embodiments may be provided with holes 238 to further assist securing of the stud form 212.

As shown in FIGS. 5–8, insulation 214 generally occupies the U-shaped channel of stud from 212. Since electrical wires, plumbing and the like can be passed through openings 226 along the legs of the U-shaped forms 212 and directly through the insulation 214, sleeves will generally not be required. In an alternate embodiment shown in FIG. 9, the insulation 214 may occupy only a portion of the U-shaped channel, thereby allowing concrete to flow into and provide support therein. In such an embodiment, sleeves 216 are preferably provided to allow the electrical wires, plumbing and the like to pass through the vertical stud 10.

Figure 10:
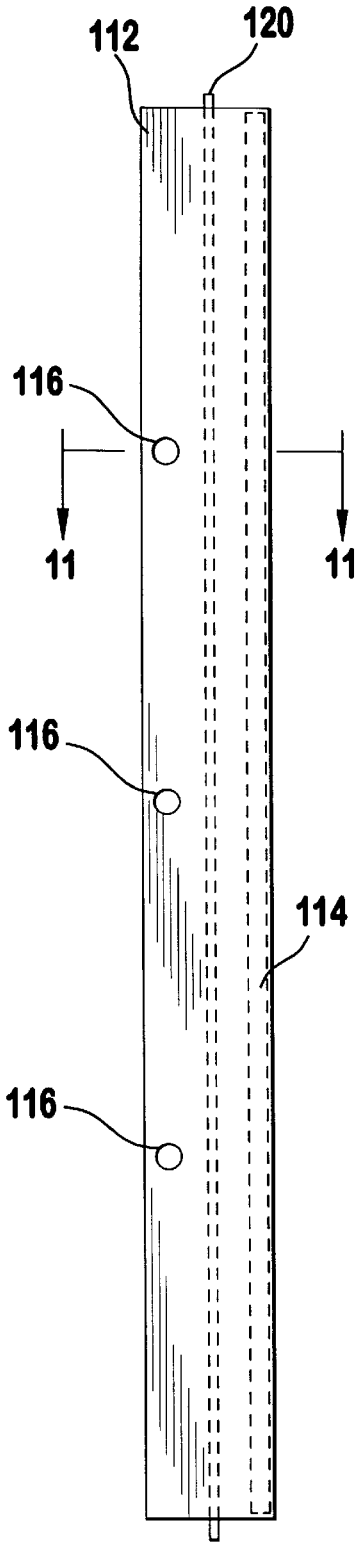
FIG. 10 is an elevation view of a vertical stud form used in the wall panel shown in FIG. 2.
Figure 11:
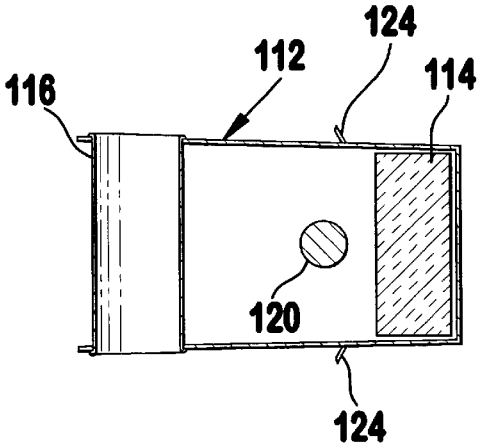
FIG. 11 is a section view taken along the line 11—11 in FIG. 10.
Figure 12:
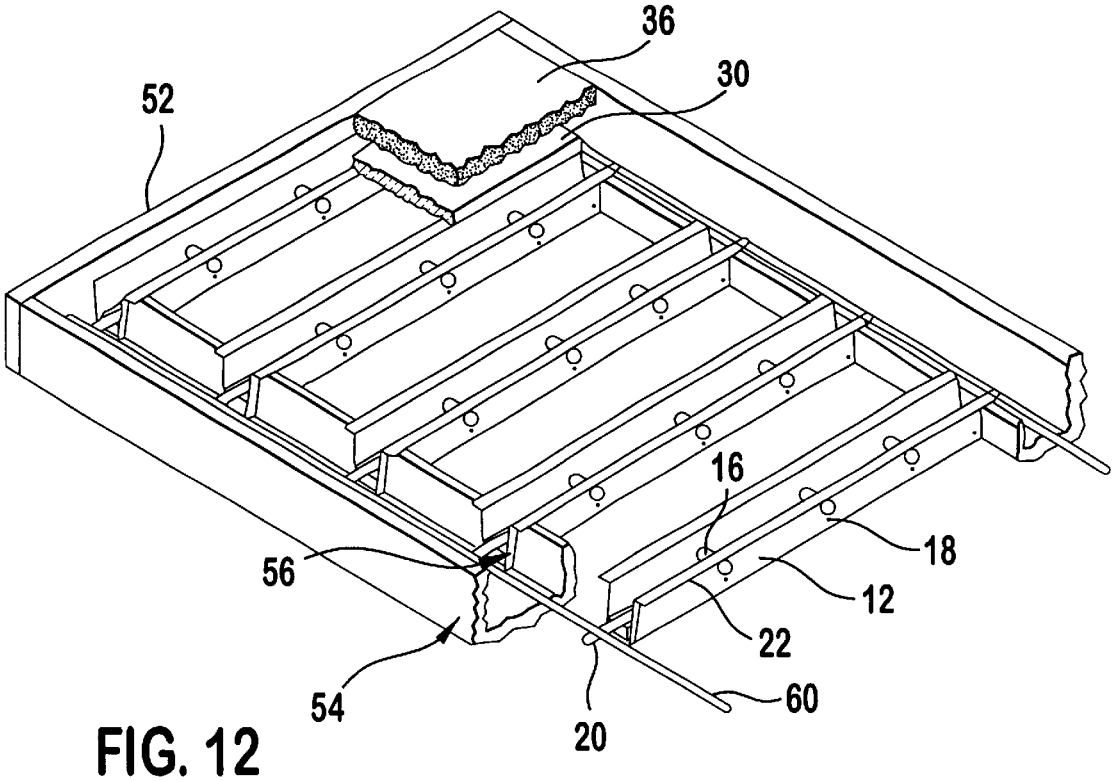
FIG. 12 is an isometric view showing an assembly for the formation of the wall panel shown in FIG. 1.

The vertical stud form 112 used to form the planar wall panels 101 is shown in FIGS. 10 and 11. The stud form 112 is generally the same as the cavity wall stud form 12 shown in FIGS. 3 and 4 except that the planar wall panel stud form 112 does not have flanges for supporting the insulation since the insulation 130 will be adjacent to the stud form 112. The stud form 112 may be provided with projections 124 to hold the insulation panels 130.

Figure 13:
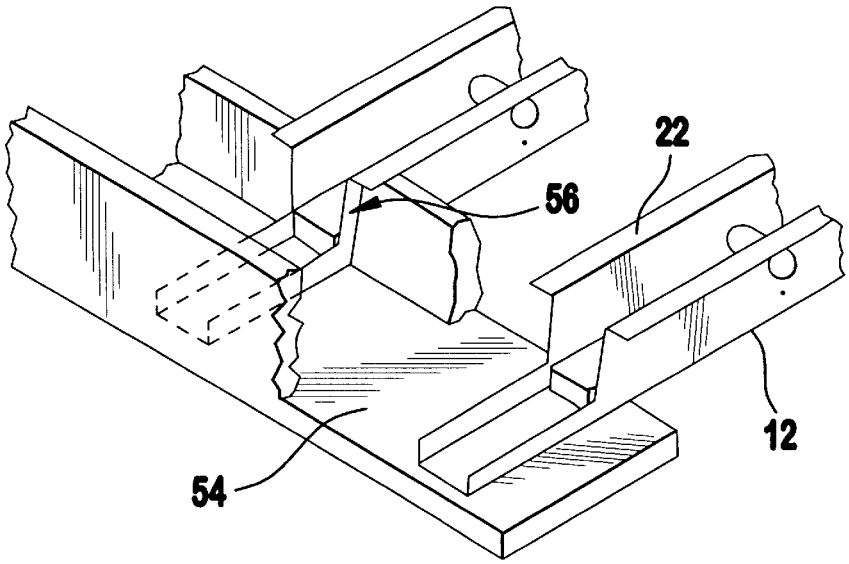
FIG. 13 is an isometric view of a portion of an assembly for formation of the wall panel shown in FIG. 1 utilizing an alternate stud form.
Figure 14:
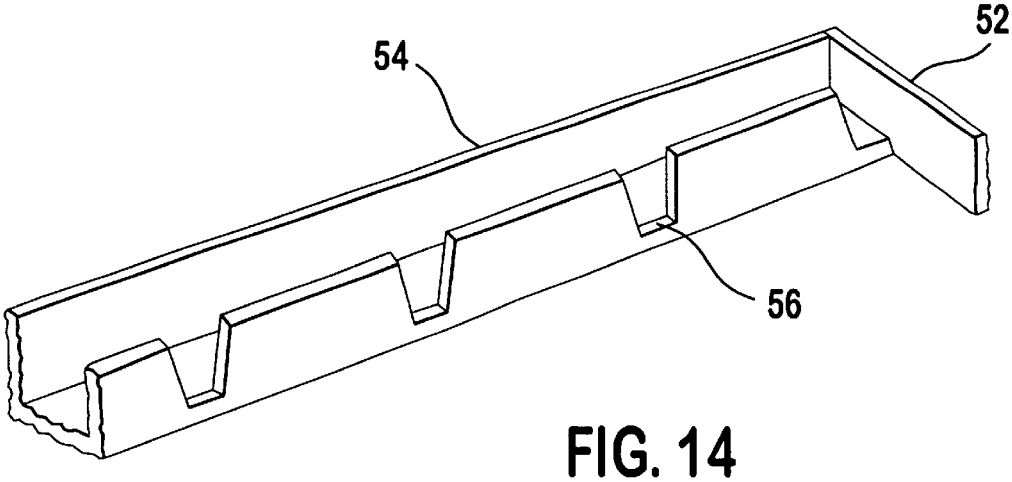
FIG. 14 is an isometric view of a portion of the top and bottom forming members.

Formation of a cavity wall panels 1 will now be described with reference to FIGS. 12–17. Formation is generally the same for each of the cavity wall stud forms 12,212. FIG. 14 shows the intersection of two walls of the forming assembly 50. The forming assembly 50 preferably comprises linear side walls 52 and top and bottom forming channels 54. The interior sides of the top and bottom forming channels 54 have a number of spaced notches 56 for receiving the vertical stud forms 12,212. The notches 56 are preferably centered at sixteen or twenty-four inches depending on the desired configuration of the wall panel 1. As can be seen in FIG. 14, the end notches 56 preferably butt against the side walls 52 to allow the end vertical stud forms 12,212 having a flange along only one edge or an inwardly extending flange, to be placed against the framing side walls 52.

Figure 15:
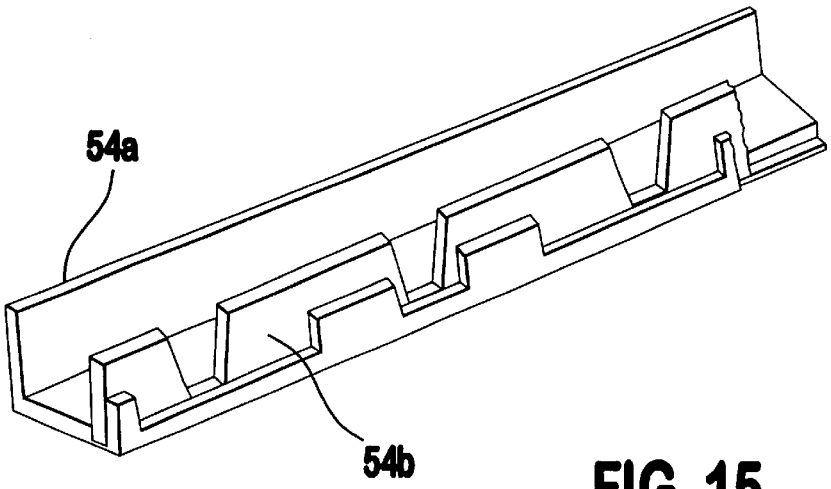
FIG. 15 is an alternate embodiment of the top and bottom forming channels.

In an alternate embodiment, shown in FIG. 15, the top and bottom forming channels 54 have an interchangeable inner wall 54*b* which fits into a permanent section of the channel 54*a*. This allows varying inner channel sections 54*b*, having differently spaced notches, at sixteen or twenty-four inch centers for example, to be quickly interchanged to produce a cavity wall panel 1 having the desired configuration.

Figure 17:
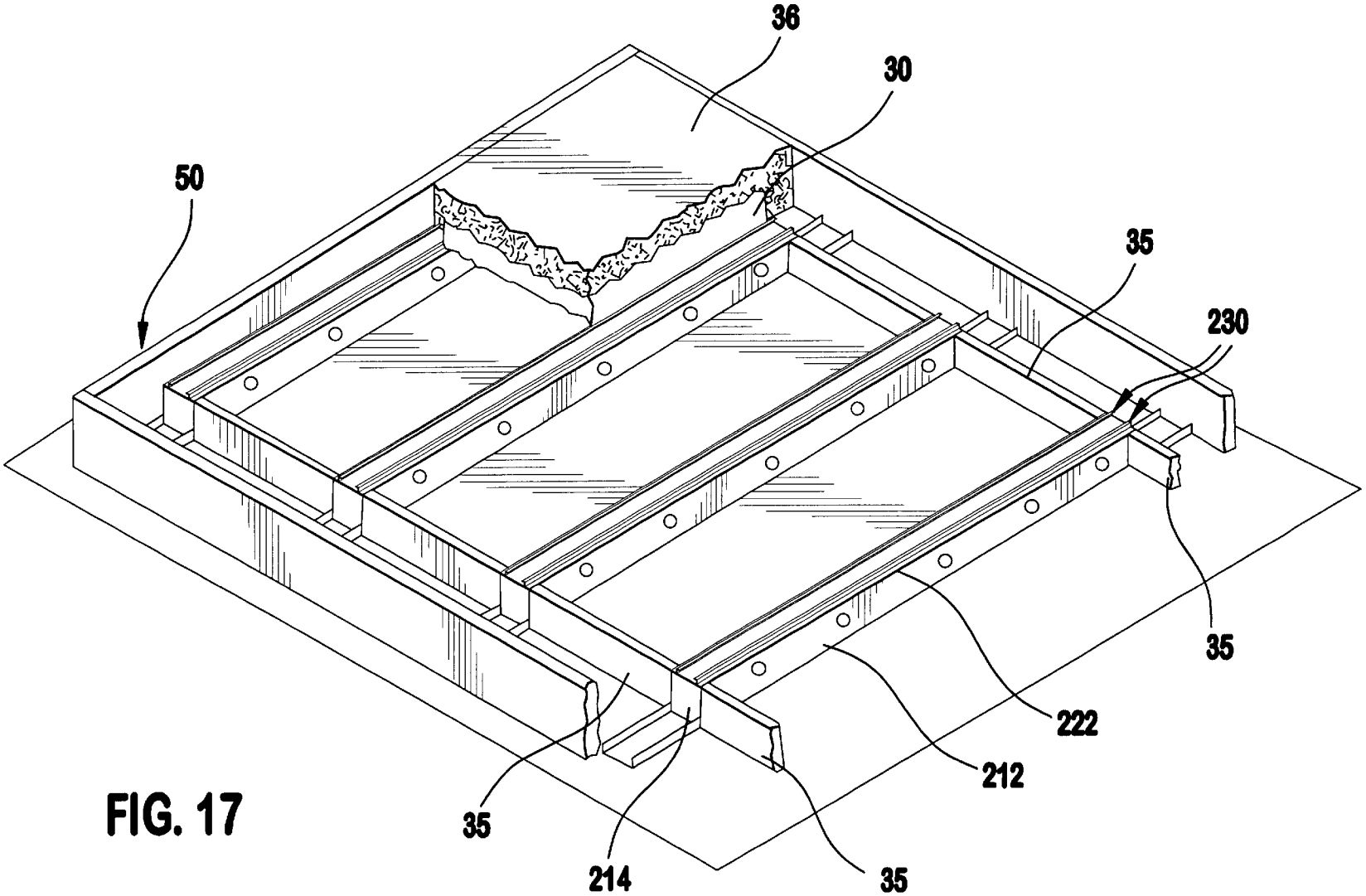
FIG. 17 is an isometric view showing an alternate assembly for the formation of the wall panel shown in FIG. 1.

With the forming assembly 50 in its desired configuration, the vertical stud forms 12 are laid in the notches 56. The stud forms 12 preferably extend slightly into the top and bottom channels 54 to lock them into the top and base beams 32 and 34 of the finished wall panel 1. Alternatively, the end of each stud form 12,212, or a portion thereof, extends the width of the respective channel 54 to abut the exterior wall of the channel 54 as shown in FIGS. 13 and 17. This helps to ensure that the stud form 12,212 maintains its position during pouring.

The rebar 20 in each stud form 12 also extends into the top and base channels 54. The vertical rebar 20 is attached to horizontal rebar 60 extending in the top and bottom channels 54. Various spacers and the like are preferably used to maintain the rebar in position prior to pouring. With the vertical stud forms 12 in place, the insulation panels 30 are placed on the flanges 22 of adjacent stud forms 12 and extend between the top and bottom channels 54 and from one stud form flange 22 to the adjacent stud form flange 22. In this position, the insulation does not cover the top and bottom channels 54 or the vertical stud form 12 U-channels. The flange projections 24 maintain the insulation panels 30 in position during pouring of the concrete. A monolithic concrete pour is used to fill the forming assembly 50. The concrete fills the top and bottom channels 54 to form the top and base beams 32 and 34 and the vertical stud forms 12 to form the vertical studs 10. The concrete also provides a solid back wall 36 of approximately two inches.

After the concrete cures, the wall panel 1 is lifted from the forming assembly 50. Since the vertical stud forms 12 are integral with the wall panel 1, the likelihood that the vertical studs 10 will crack or be improperly formed is greatly reduced. Furthermore, since the sleeves 16 are integral with the wall panel 1, there is no need for drilling or cutting conduit passages in the vertical studs 10.

Figure 16:
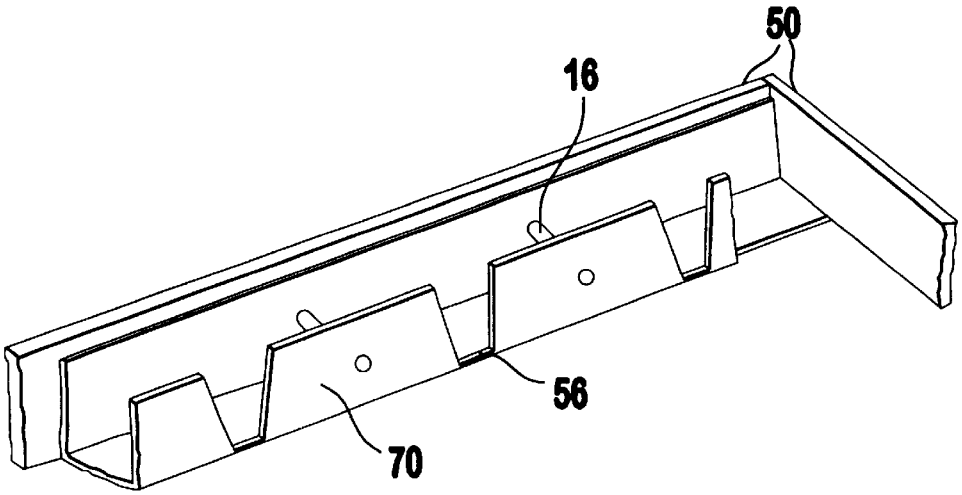
FIG. 16 is an isometric view of a horizontal stud form positioned in the forming assembly.

In an alternate embodiment of the cavity wall 1, all of the forming members 50 are linear walls. The top and bottom channels 54 are formed by horizontal stud forms 70 placed within the forming assembly 50, as shown in FIG. 16. The horizontal stud forms 70 are similar to the vertical stud forms 12 and also form an integral part of the wall panel 1. The horizontal stud forms 70 differ from the vertical stud forms 12 in that each has a side wall with notches 56 to receive the vertical stud forms 12. Formation of the wall panel 1 is simplified since the wall panel 1 does not require lifting from the top and bottom channels. Instead, the forming members 50 can simply be disassembled.

Another embodiment of the cavity wall panel 1 is shown in FIG. 17. As with the previous embodiment, the forming members 50 are linear walls. The stud forms 12,212 within the forming members 50 in their desired locations. Horizontal insulation panels 35 are positioned between the adjacent stud forms 12,212 and prevent the poured concrete from passing from the top and bottom beams 32 and 34 between adjacent stud forms 12,212. Use of various size horizontal insulation panels 35 permits greater flexibility in positioning of the stud forms 12,212. Once the stud forms 12,212 are positioned, the remaining components are placed in the frame, a monolithic concrete pour is provided and the completed wall panel 1 is removed from the forming members in manner similar to that described above. The horizontal insulation panels 35 may be maintained in the finished wall panel 1 or removed after removal of the wall panel from the forming members 50.

Figure 18:
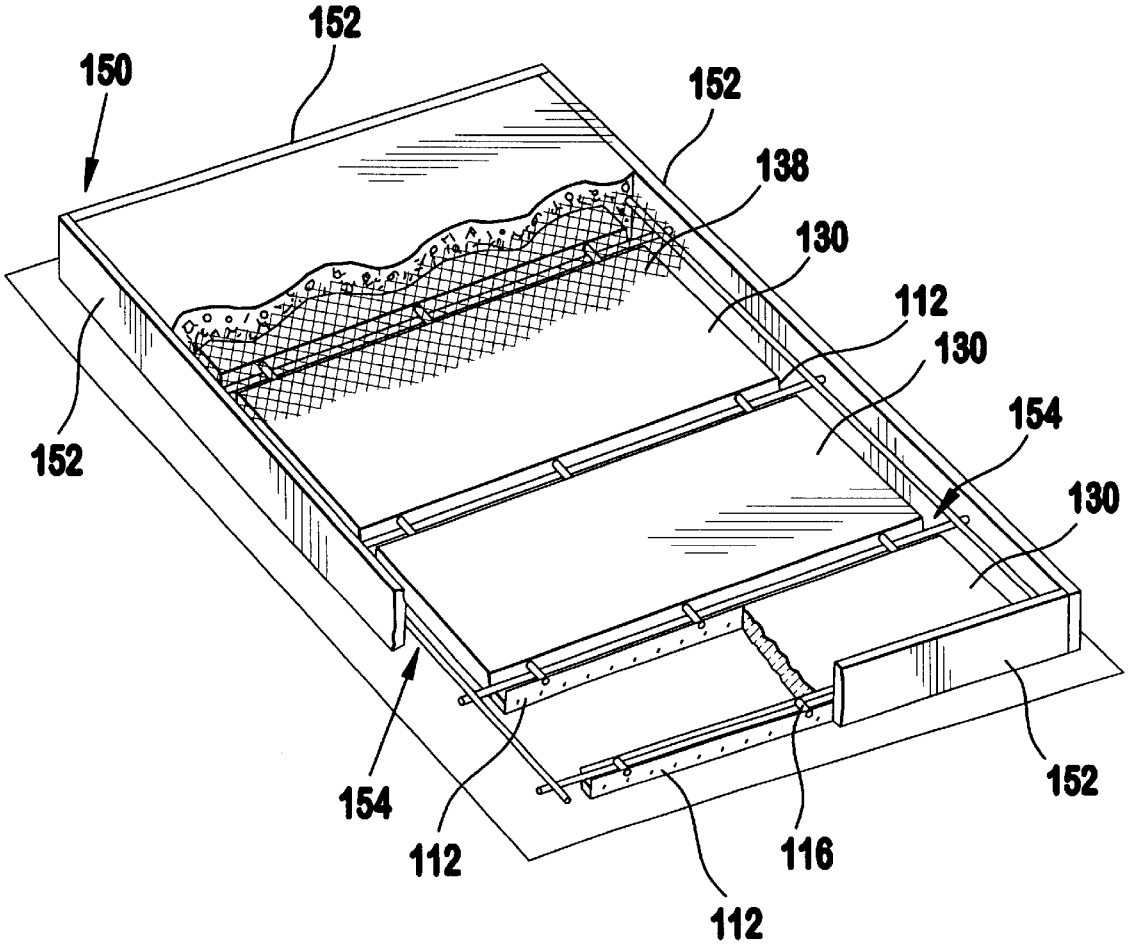
FIG. 18 is an isometric view showing an assembly for the formation of the wall panel shown in FIG. 2.

FIG. 18 shows the formation of a planar wall panel 101. Forming members 152 are connected to define forming assembly 150. In the preferred embodiment, a stud form 112 is laid flat in the frame so that it extends along one of the end frame members 150. Additional stud forms 112 are placed parallel to the first stud form 112 on sixteen or twenty four inch centers. The studs forms 112 have a length which is less than the length of forming members 152 whereby channels 154 exist at the top and bottom of the forming assembly 150.

Four inch thick expanded foam insulation panels 130, extending the length of the stud forms 112, are placed between adjacent stud forms 112. Reinforcing steel bars 160, extending the length of the wall panel 101, are placed in the top and bottom channels 154. A wire mesh 138 is laid over the entire surface within the framing members. Conventional wet concrete is poured into the form 150, filling all of the empty space within the form and providing a slab of at least two inch (2") thick concrete along the entire back of the wall. The concrete will fill the top and bottom channels and form the top and bottom beams 132 and 134. The concrete surrounds the sleeves 116 and thereby forms the integral vertical studs 110.

I claim:

1. A stud form of a type used in forming a preformed concrete wall panel characterized by:

a substantially U-shaped channel having a face portion that defines an elongated plane and leg portions extending along side of and away from the elongated plane, each leg portion portion including a support portion adapted to support a portion of an insulation panel; and means for integrally connecting the stud form to the wall panel.

2. The stud form of claim 1 wherein the connecting means includes at least one sleeve extending between the leg portions.

3. The stud form of claim 1 wherein each support portion has a plurality of projections for maintaining the insulation panel in position.

4. The stud form of claim 1 wherein each support portion extends generally parallel to the elongated plane.

5. The stud form of claim 1 wherein each leg portion has a given length and the face portion includes extension portions such that the face portion has a length greater than the length of each leg portion.

6. The stud form of claim 1 wherein the connecting means includes an additional leg portion extending from each support portion.

7. The stud form of claim 6 wherein each connecting leg portion includes at least one aperture therethrough.

8. The stud form of claim 6 wherein each connecting leg portion is a planar member.

9. The stud form of claim 8 wherein each connecting leg portion extends from the respective support portion at an angle relative to the elongated plane.

10. The stud form of claim 9 wherein the angle is approximately 90 degrees.

11. The stud form of claim 9 wherein the angle is approximately 45 degrees.

12. The stud form of claim 6 wherein each connecting leg portion is an L-shaped member.

13. The stud form of claim 12 wherein each connecting leg portion extends from the respective support portion such that a portion of the L-shaped member extends generally perpendicular to the elongated plane and a portion of the L-shaped member extends generally parallel to the elongated plane.

14. A preformed concrete wall panel comprising:

a solid portion;

a plurality of vertical concrete studs;

a plurality of insulating panels;

a plurality of stud forms, each associated with a vertical concrete stud and having:

a substantially U-shaped channel having a face portion that defines an elongated plane and leg portions that extend along side of and away from the elongated plane, each leg portion including a support portion for supporting a portion of an insulation panel extending between adjacent stud forms; and means for integrally connecting the stud form to the solid portion of the wall panel.

15. The preformed wall of claim 14 wherein the wall is a cavity wall.

16. The preformed wall of claim 14 further comprising top and bottom concrete beams.

17. The preformed wall of claim 16 further comprising a stud form associated with each beam and having at least two legs, one of the legs having a plurality of notches for receiving the stud forms associated with the vertical studs.

18. The preformed wall of claim 16 wherein the face portion of each stud form includes extension portions which extend into the respective beams.

19. The stud form of claim 14 wherein the connecting means includes at least one sleeve extending between the leg portions.

20. The stud form of claim 14 wherein each support portion has a plurality of projections for maintaining the insulation panel in position.

21. The stud form of claim 14 wherein each support portion extends generally parallel to the elongated plane.

22. The stud form of claim 14 wherein the connecting means includes an additional leg portion extending from each support portion.

23. The stud form of claim 22 wherein each connecting leg portion includes at least one aperture therethrough.

24. The stud form of claim 22 wherein each connecting leg portion is an L-shaped member.

25. The stud form of claim 24 wherein each connecting leg portion extends from the respective support portion such that a portion of the L-shaped member extends generally perpendicular to the elongated plane and a portion of the L-shaped member extends generally parallel to the elongated plane.

26. The stud form of claim 22 wherein each connecting leg portion is a planar member.

27. The stud form of claim 26 wherein each connecting leg portion extends from the respective support portion at an angle relative to the elongated plane.

28. The stud form of claim 27 wherein the angle is approximately 90 degrees.

29. The stud form of claim 27 wherein the angle is approximately 45 degrees.

30. A system for forming preformed insulated concrete walls in a single pour, the system comprising:

a frame assembly that defines the overall perimeter of a wall;

means for forming top and bottom beams within the frame assembly;

a plurality of insulation panels;

a plurality of stud forms extending between the top and bottom beam forming means, each stud form including:

a substantially U-shaped channel having a face portion that defines an elongated plane and leg portions extending along side of and away from the elongated plane, each leg portion including a support portion for supporting a portion of an insulation panel extending between adjacent stud forms; and means for integrally connecting the stud form to the wall panel.

* * * * *